US009281631B2

(12) United States Patent
Lin et al.

(10) Patent No.: US 9,281,631 B2
(45) Date of Patent: Mar. 8, 2016

(54) CONNECTOR AND STORAGE DEVICE USING THE SAME

(71) Applicant: PHISON ELECTRONICS CORP., Miaoli (TW)

(72) Inventors: Wei-Hung Lin, Hsinchu County (TW); Hsien-Sheng Tsao, Hsinchu (TW); Yun-Chieh Chen, Hsinchu County (TW)

(73) Assignee: PHISON ELECTRONICS CORP., Miaoli (TW)

( * ) Notice: Subject to any disclaimer, the term of this patent is extended or adjusted under 35 U.S.C. 154(b) by 136 days.

(21) Appl. No.: 14/281,867

(22) Filed: May 19, 2014

(65) Prior Publication Data

US 2015/0280378 A1 Oct. 1, 2015

(30) Foreign Application Priority Data

Mar. 27, 2014 (TW) ..... 103205311 U

(51) Int. Cl.

| | |
|---|---|
| ***H01R 12/71*** | (2011.01) |
| ***H01R 13/6594*** | (2011.01) |
| ***H01R 12/70*** | (2011.01) |
| ***H01R 12/72*** | (2011.01) |
| *H01R 13/6581* | (2011.01) |

(52) U.S. Cl.

CPC ..... *H01R 13/6594* (2013.01); *H01R 12/7011* (2013.01); *H01R 12/716* (2013.01); *H01R 12/724* (2013.01); *H01R 13/6581* (2013.01)

(58) Field of Classification Search

CPC ..... H01R 12/716; H01R 13/6594

See application file for complete search history.

(56) References Cited

U.S. PATENT DOCUMENTS

| | | | | |
|---|---|---|---|---|
| 7,699,663 | B1 * | 4/2010 | Little | H01R 13/65802 439/660 |
| 9,136,661 | B1 * | 9/2015 | Lin | H01R 31/06 |
| 2006/0234530 | A1 * | 10/2006 | Chung | H05K 3/341 439/79 |
| 2009/0215284 | A1 * | 8/2009 | Zhao | H01R 13/64 439/55 |
| 2010/0304611 | A1 * | 12/2010 | He | H01R 13/6658 439/607.01 |
| 2012/0040567 | A1 * | 2/2012 | Ho | H01R 12/725 439/660 |
| 2014/0078662 | A1 * | 3/2014 | Lin | H05K 5/0278 361/679.32 |
| 2014/0268536 | A1 * | 9/2014 | Herman | H05K 3/30 361/679.31 |
| 2014/0287625 | A1 * | 9/2014 | Chan | H01R 13/6594 439/607.01 |
| 2014/0337555 | A1 * | 11/2014 | Chung | G06F 13/4081 710/301 |
| 2015/0087167 | A1 * | 3/2015 | Chen | G06F 3/08 439/95 |
| 2015/0280378 | A1 * | 10/2015 | Lin | H01R 12/7011 361/679.32 |
| 2015/0318643 | A1 * | 11/2015 | Lane | H01R 13/6594 439/607.35 |

* cited by examiner

*Primary Examiner* — James Harvey

(74) *Attorney, Agent, or Firm* — Jianq Chyun IP Office

(57) ABSTRACT

A connector suitable for a storage device is provided. The storage device has a storage module. The connector includes a body, a plurality of terminals, and a housing. The terminals are disposed in the body, and a first end of each terminal protrudes from the body and is electrically connected to the storage module. The housing covers the body and has an indentation and a shielding portion. The first end of each terminal is located at the indentation. The shielding portion shields the indentation, and the first end of each terminal is located between the shielding portion and the storage module. A storage device is also provided.

20 Claims, 6 Drawing Sheets

CONNECTOR AND STORAGE DEVICE USING THE SAME

CROSS-REFERENCE TO RELATED APPLICATION

This application claims the priority benefit of Taiwan application serial no. 103205311, filed on Mar. 27, 2014. The entirety of the above-mentioned patent application is hereby incorporated by reference herein and made a part of this specification.

FIELD OF THE INVENTION

The present invention is directed to a connector and a storage device using the same.

DESCRIPTION OF RELATED ART

With development of multimedia technology, produced digital files become larger in size. Although a conventional 1.44 MB floppy disk is easy to carry, a capacity thereof cannot meet current needs. Moreover, although a conventional disk-structure type hard disk can provide a large storage space, it is inconvenient to carry due to its large size. Recently, with the popularization of universal serial bus (USB) interfaces and the price reduction of flash memories, USB flash disks advantaged in large storage capacity, great compatibility, and portability have been extensively applied to transmit data between various computers and storage devices.

A flash disk featuring in large storage capacity, plug-and-play, compact size and portability has taken the place of the floppy disk. The flash disk is electrically connected to a computer host through a connector (e.g., a USB plug or an IEEE 1394 plug) by means of a storage module connected thereto.

Nevertheless, when the flash disk is repeatedly plugged in and out and used for a long time, a damage or even a peeling-off problem may occur between the storage module and the connector due to the force of continuous plug-in and out, which leads to a risk of electric disconnection and unstable signal transmission. Accordingly, how to improve a structure strength between the storage module and the connector has become a subject that person skilled in the art has to deal with.

Nothing herein should be construed as an admission of knowledge in the prior art of any portion of the present invention. Furthermore, citation or identification of any document in this application is not an admission that such document is available as prior art to the present invention, or that any reference forms a part of the common general knowledge in the art.

SUMMARY

The present invention provides a connector and a storage device using the same. Strength of connection among the connector, and a storage module can be enhanced by shielding portions of the housing.

The present invention is directed to a connector suitable for a storage device. The storage device has a storage module. The connector includes a body, a plurality of terminals, and a first housing. The terminals are disposed in the body. A first end of each terminal protrudes from the body and is electrically connected to the storage module. The first housing covers the body and has a first indentation and a shielding portion. The first end of each terminal is located at the first indentation, and the shielding portion shields the first indentation, such that the first end of each terminal is located between the shielding portion and the storage module.

The present invention is directed to a storage device including a storage module and a connector. The storage module has a first connection interface. The connector includes a body, a plurality of terminals, and a first housing. The terminals are disposed in the body. A first end of each terminal protrudes from the body and is electrically connected to the storage module. The first housing covers the body and has a first indentation and a shielding portion. The first end of each terminal is located at the first indentation, and the shielding portion shields the first indentation, such that the first end of each terminal is located between the shielding portion and the storage module.

In an exemplary embodiment of the present invention, the first housing further has a pair of wing portions extending from opposite sides of the shielding portion in a direction departing away from the first indentation. The connector is assembled to the storage module by means of the pair of wing portions.

In an exemplary embodiment of the present invention, the body has a first protrusion portion located at the first indentation. The first protrusion portion abuts between the shielding portion and the storage module and has a second indentation corresponding to the first indentation. The first end of each terminal is located at the second indentation.

In an exemplary embodiment of the present invention, the first housing further has an elastic piece, and the storage device further includes a second housing. The storage module and a portion of the connector are contained in the second housing, and the elastic piece abuts against the second housing.

In an exemplary embodiment of the present invention, the body further has a second protrusion portion extending from the shielding portion and abutting against a side surface of the storage module.

In an exemplary embodiment of the present invention, the first housing and the second housing are conductive.

In an exemplary embodiment of the present invention, the body includes a first unit and a second unit. The first unit is located adjacent to the first indentation. The terminals penetrate the first unit. A portion of the first unit is sheathed in the second unit. A second end of each terminal penetrates through the second unit and is exposed from the second unit.

In an exemplary embodiment of the present invention, the first unit has a third protrusion portion extending in a direction departing away from the first end of each terminal and a second locking portion disposed on the third protrusion. The second unit has a hollow portion, a plurality of slots and a first locking portion which is located on opposite sides of the hollow portion. The third protrusion portion is assembled to the hollow portion, and the first and the second locking portions are locked with each other, so as to assemble the first unit and the second unit, and the second end of each terminal penetrates through the hollow portion and is exposed from the second unit through each of the corresponding slots.

In an exemplary embodiment of the present invention, the second end of each terminal, a portion of the second unit and a portion of the first housing form a second connection interface.

In an exemplary embodiment of the present invention, the second connection interface complies with a micro universal serial bus (Micro-USB) standard.

In an exemplary embodiment of the present invention, the first connection interface complies with a universal serial bus 2.0 (USB 2.0) standard.

In an exemplary embodiment of the present invention, the first connection interface complies with a universal serial bus 3.0 (USB 3.0) standard.

To sum up, in the exemplary embodiments of the present invention, by means of the first indentation and the shielding portion of the connector, the first end of each terminal disposed in the body is electrically connected with the storage module while being shielded by the shielding portion due to being located at the first indentation. In other words, with the structure composed of the shielding portion and the first indentation provided by the first housing of the connector, the terminals disposed in the connector can be effectively protected from being damaged by any external force due to unstable structure.

It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
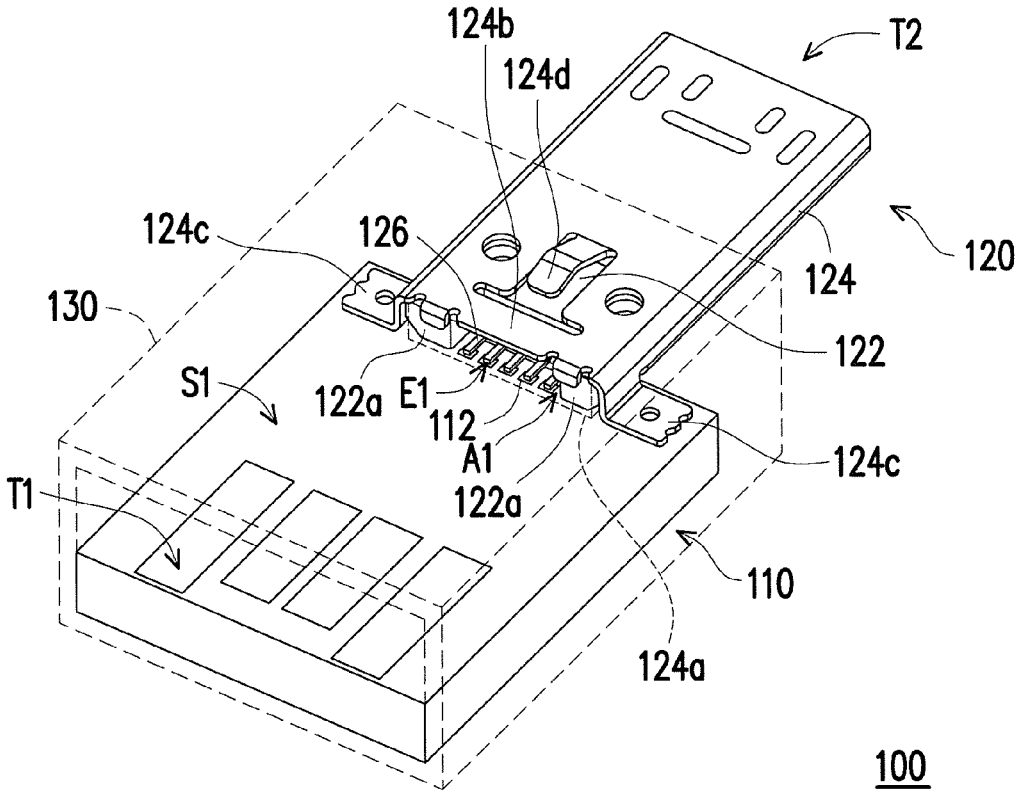
FIG. 1 is a schematic diagram of a storage device according to an exemplary embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Embodiments of the present invention may comprise any one or more of the novel features described herein, including in the Detailed Description, and/or shown in the drawings. As used herein, "at least one", "one or more", and "and/or" are open-ended expressions that are both conjunctive and disjunctive in operation. For example, each of the expressions "at least on of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Figure 2:
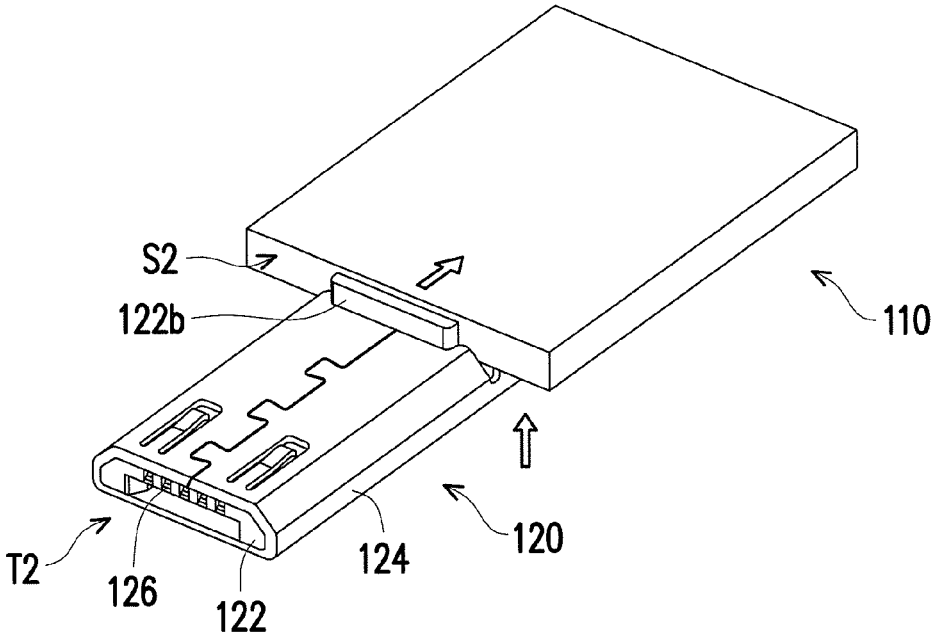
FIG. 2 illustrates a part of elements of the storage device of FIG. 1 in another view angle.

It is to be noted that the term "a" or "an" entity refers to one or more of that entity. As such, the terms "a" (or "an"), "one or more" and "at least one" can be used interchangeably herein FIG. 1 is a schematic diagram of a storage device according to an exemplary embodiment of the present invention. FIG. 2 illustrates a part of elements of the storage device of FIG. 1 in another view angle. Referring to both FIGS. 1 and 2, in the present exemplary embodiment, a storage device 100 may be, for example, a flash disk and includes a storage module 110 and a connector 120 which are connected with each other. In the storage modules 110, related electronic elements (which are not shown herein) are packaged together by a system in package (SIP) technique using a package body. The connector 120 includes a body 122, a first housing 124 and a plurality of terminals 126 (where only one terminal is labeled as a representative) disposed in the body 122. A side of the connector 120 is electrically connected with the storage module 110 through the terminals 126, such that the other side is served as a connection interface for electrically connection and signal transmission between the storage module 110 and other electronic devices. In the present exemplary embodiment, the storage module 110 has a first connection interface T1 which is formed by, for example, a plurality of exposed terminals and complies with a universal serial bus 2.0 (USB 2.0) standard. Additionally, the connector 120 of the present exemplary embodiment forms a second connection interface T2 which complies with a micro universal serial bus (Micro-USB) standard and is electrically connected with the first connection interface T1 through related circuits and elements of the storage module 110, and the present invention is not limited to the exemplary embodiment set forth herein.

Figure 3:
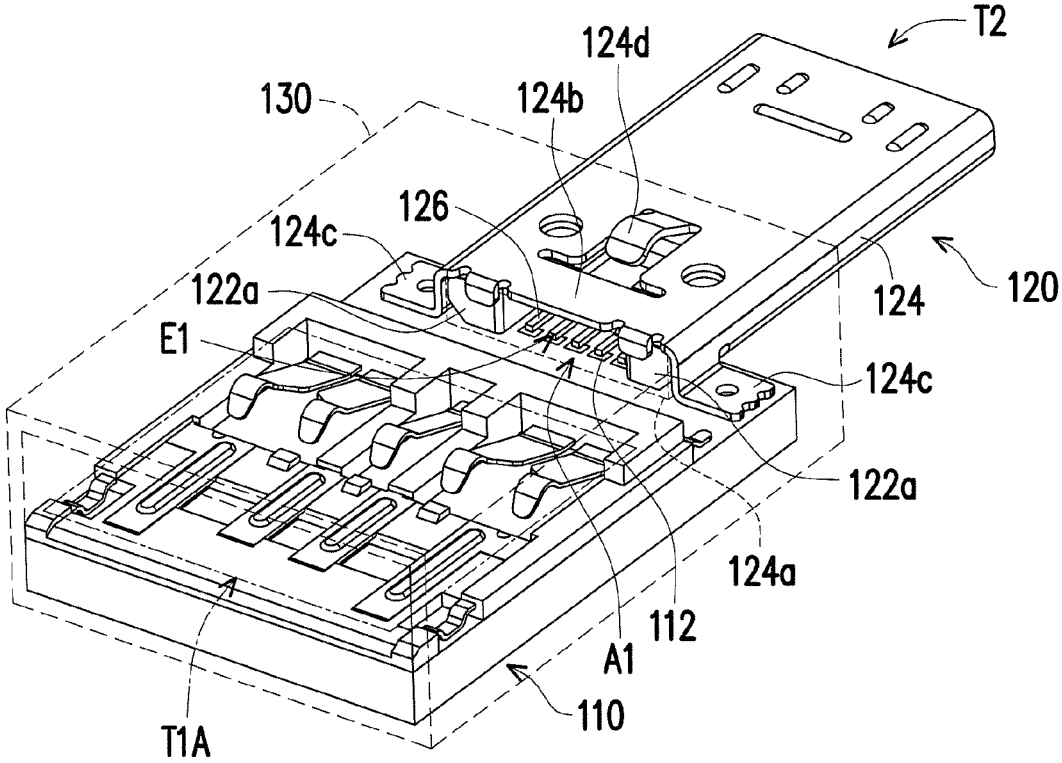
FIG. 3 is a schematic diagram of a storage device according to another exemplary embodiment of the present invention.

FIG. 3 is a schematic diagram of a storage device according to another exemplary embodiment of the present invention. With reference to FIG. 3, differing from the above exemplary embodiments, in the present exemplary embodiment, a first connection interface T1A of the storage module 110 complies with a universal serial bus 3.0 (USB 3.0) standard. Based on the above, a designer can configure different connection interfaces on the storage device 100 of the present invention according to usage requirements.

Figure 4:
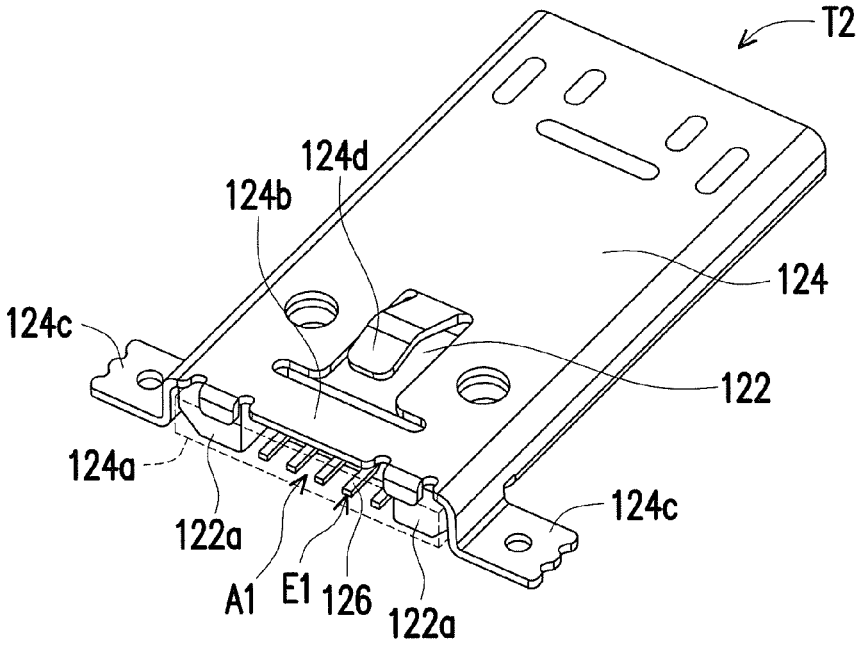
FIG. 4 and FIG. 5 respectively illustrate the storage module and the connector of the storage device of FIG. 1 in different viewing angles.
Figure 5:
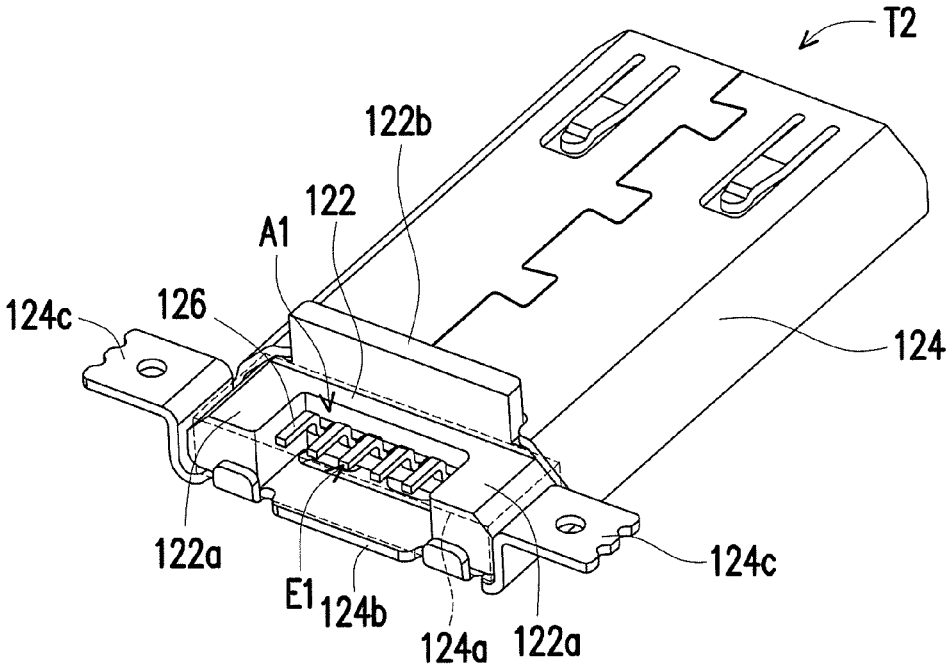

FIG. 4 and FIG. 5 respectively illustrate the storage module and the connector of the storage device of FIG. 1 in different viewing angles. With reference to FIG. 1, FIG. 2, FIG. 4 and FIG. 5, in the present exemplary embodiment, a material of the body 122 is, for example, plastic. The terminals 126 are disposed in the body 122, and a first end E1 of each terminal 126 protrudes from the body 122 and is electrically connected to the storage module 110. Moreover, a material of the first housing 124 is, for example, metal. The first housing 124 covers the body 122. It should be noted that the first housing 124 has a first indentation 124*a* (i.e., an area illustrated by a dashed line) and a shielding portion 124*b*. The first end E1 of each terminal 126 is located at the first indentation 124*a*. Thus, referring to FIG. 1, the shielding portion 124*b* shields the first indentation 124*a*, such that the first end E1 of each terminal 126 is located between the shielding portion 124*b* and the storage module 110.

In other words, it is apparent according to FIG. 1, FIG. 2, FIG. 4 and FIG. 5 that in the storage device 100 of the present exemplary embodiment, the body 122 of the connector 120 has a first protrusion portion 122*a* extending to the first indentation 124*a* and a second indentation A1 existing in the first protrusion portion 122*a* based on structural characteristics of the first indentation 124*a* of the first housing 124. The first protrusion portion 122*a* is located in the first indentation 124*a* and contacts a surface S1 of the storage module 110. Relatively, the other side of the first protrusion portion 122*a* that is away from the storage module 110 is disposed on the first protrusion portion 122*a* by the shielding portion 124*b* of the first housing 124. Thereby, the first protrusion portion 122*a* substantially abuts between the shielding portion 124*b* and the surface S1 of the storage module 110. Moreover, the second indentation A1 corresponds to the first indentation 124*a*, such that the first end E1 of each terminal 126 is located in the second indentation A1 and electrically connected with each pad 112 (where only one pad is labeled as a representative) located on the surface S1 of the storage module 110 correspondingly.

Additionally, the first housing 124 further has a pair of wing portions 124*c* extending from opposite sides of the shielding portion 124*b* in a direction departing away from the first indentation 124*a* (also extending in a direction departing away the second indentation A1). After the body 122 is sheathed in the first housing 124, the connector 120 may be assembled onto the surface S1 of the storage module 110 by means of the pair of wing portions 124*c*. Herein, the manner of the aforementioned assembly is not limited, and namely, the connector 120 may be fixed to the storage module 110 by screwing, adhering or welding the wing portions 124*c* to the storage module 110.

Based on the above description, with the characteristics of the first indentation 124*a* from the first housing 124, the first protrusion portion 122*a* of the body 122 is located in the first indentation 124*a* so as to be served as a structure for contacting the connector 120 with the storage module 110. As long as the connector 120 is assembled to the storage module 110 by means of the pair of wing portions 124*c* of the first housing 124, a sandwich structure may be formed by the storage module 110, the first protrusion portion 122*a* and the shielding portion 124*b*. Thus, the structure strength can be enhanced when the connector 120 is assembled to the storage module 110. Moreover, the shielding portion 124*b* may shield both the second indentation A1 located in the first protrusion portion 122 and the first end E1 of each terminal 126 located in the second indentation A1. Thus, the first end E1 of each terminal 126 may be so protected.

Referring to FIG. 1 again, the storage device 100 further includes a second housing 130, and the first housing 124 of the connector 120 further has an elastic piece 124*d*. In this case, the second housing 130 is illustrated by a dashed line for distinguishing the corresponding relation between the second housing 130 and the connector 120. In the present exemplary embodiment, both the second housing 130 and the first housing 124 are made of metal or have conductivity. The elastic piece 124*d* extends along a direction departing away from the body 122 (i.e., toward the second housing 130). Thus, when the storage module 110 and the connector 120 are together assembled to the second housing 130, the elastic piece 124*d* abuts against an inner surface of the second housing 130. In this way, in addition to the elastic piece 124*d* serving to fix the storage module 110, the connector 120 and the second housing 130, more important, the first housing 124 and the second housing 130 can be electrically conducted on by means of contacting the elastic piece 124*d* so as to achieve an electrostatic discharge (ESD) effect. Therefore, electronic elements in the storage module 110 and other electronic devices connected with the storage device 100 can be prevented from being damaged due to electrostatic.

Referring to both FIG. 2 and FIG. 4, in the present exemplary embodiment, the body 122 of the connector 120 further has a second protrusion portion 122*b*. The second protrusion portion 122*b* extends from the shielding in a direction departing away from the shielding portion 124*b* and is substantially perpendicular to the first protrusion portion 122*a*. Referring to FIG. 2, while the first protrusion portion 122*a* of the body 122 of the connector 120 contacts the surface S1 of the storage module 110, the second protrusion portion 122*b* of the body 122 also contacts a side surface S2 of the storage module 110. That is, with the assembly structure of a three-dimensional space achieved by the first protrusion portion 122*a* and the second protrusion portion 122*b*, the assembly and fixing strength between the connector 120 and the storage module 110 can be enhanced in different directions (as the two bold-line arrows shown in FIG. 2).

Figure 6:
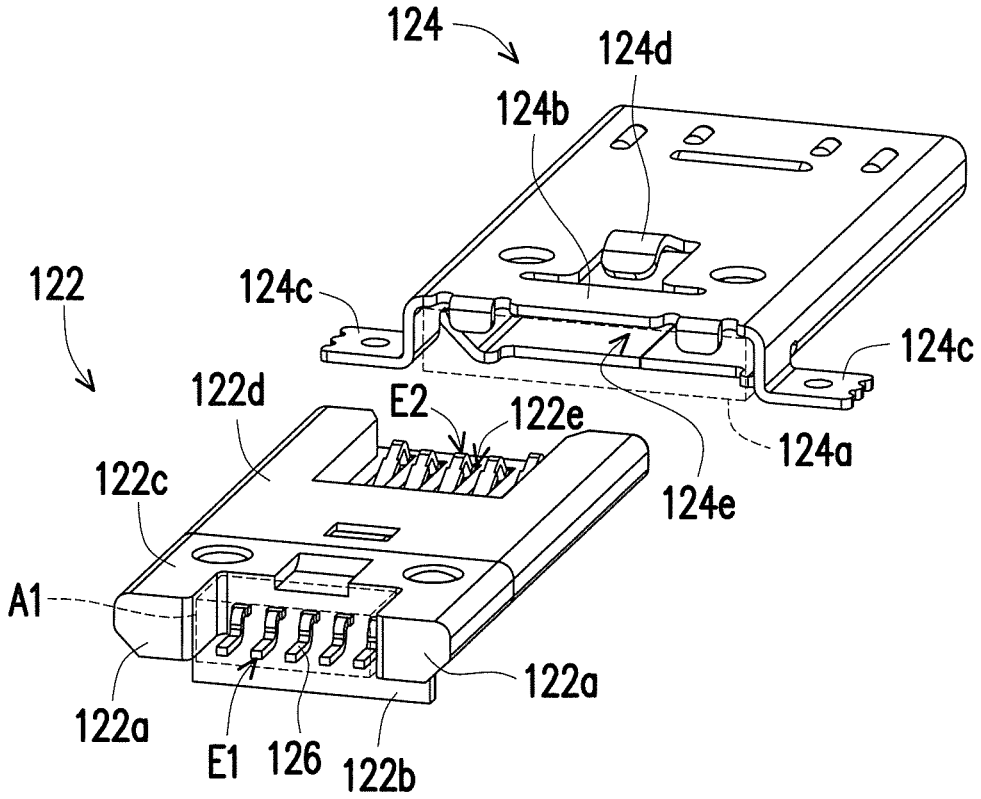
FIG. 6 through FIG. 8 are exploded diagrams respectively illustrating the connector in different degrees.
Figure 7:
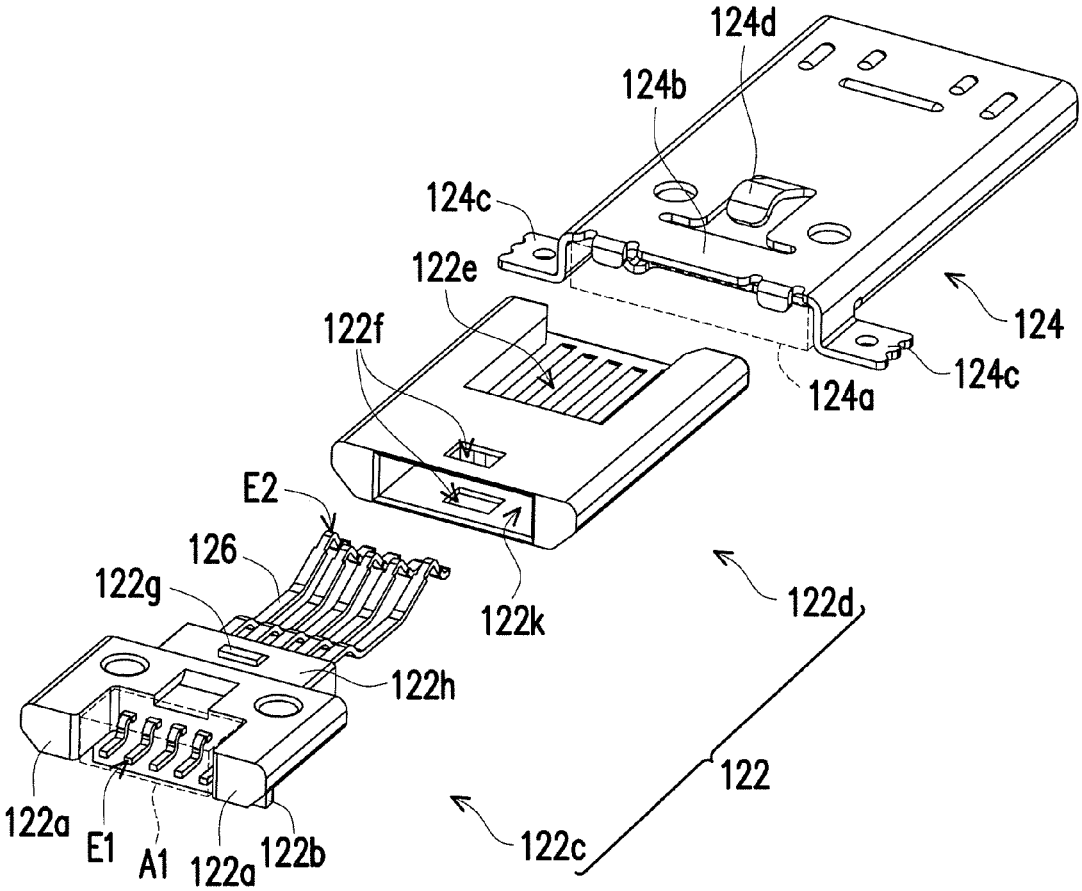
Figure 8:
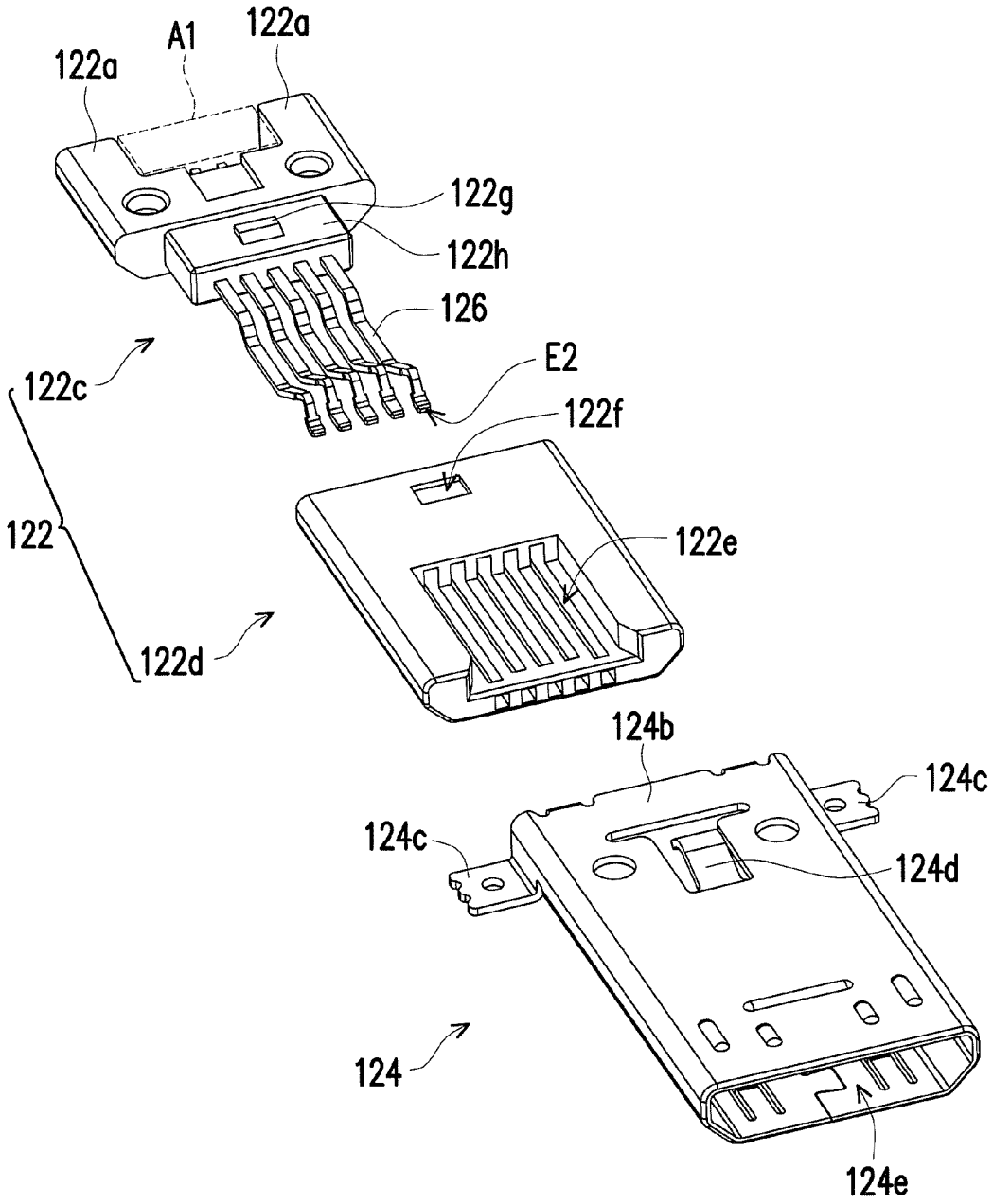

FIG. 6 through FIG. 8 are exploded diagrams respectively illustrating the connector in different degrees. Referring to FIG. 5 to FIG. 7, the first housing 124 may be considered as a sheath member having a hollow portion 124*e*, such that the body 122 may be sheathed in the hollow portion 124*e* of the first housing 124. Moreover, the body 122 may be further divided into a first unit 122*c* and a second unit 122*d*. The terminals 126 penetrates through the first unit 122*c* by insert molding manner, such that the first end E1 of each terminal 126 is located in the second indentation A1 of the first protrusion portion 122*a*.

Moreover, the second unit 122*d* has a first locking portion 122*f*, a hollow portion 122*k*, and a plurality of slots 122*e*. The first unit 122*c* has a second locking portion 122*g* disposed on a third protrusion portion 122*h* that is away from the first protrusion portion 122*a*. Thereby, the third protrusion portion 122*h* is embedded in the hollow portion 122*k* to achieve the assembly of the first unit 122*c* and the second unit 122*d*, and the first unit 122*c* and the second unit 122*d* are successfully fixed together by locking the first locking portion 122*f* (e.g., a locking hole) with the second locking portion 122*g* (e.g., a tenon). As such, the second end E2 of each terminal 126 may penetrate through the hollow portion 122*k* and is exposed from the second unit 122*d* through each corresponding slot 122*e*, such that the second end E2 of each terminal 126, a portion of the second unit 122*d* and a portion of the first housing 124 form the second connection interface T2 described above. Therefore, in the follow-up assembly process, the first unit 122*c* and second unit 122*d* are assembled into the first housing 124, and the first unit 122*c* is adjacent to the first indentation 124*a* of the first housing 124.

To conclude, in the exemplary embodiments of the present invention, by utilizing the characteristics of the first indentation and the shielding portion of the first housing, the first end of each terminal can be shielded and protected by the shielding portion while being electrically connected with the storage module, and the first protrusion portion of the body is further sandwiched between the shielding portion and the storage module. Thereby, the connector substantially contacts the storage module with the body. When the wing portions of the first housing are assembled onto the storage module, the first protrusion portion is sandwiched between the shielding portion and the storage module. Thus, the structure strength between the connector and the storage module can be enhanced by the sandwich structure formed by the shielding portion, the first protrusion portion and the storage module. Moreover, both the first housing and the second housing of the storage device have conductivity. Thus, when the storage module and the connector are assembled into the second housing, the elastic piece on the first housing abuts against the inside wall of the second housing, so as to achieve the ESD effect when the first housing and the second housing are electrically conducted on. The previously described exemplary embodiments of the present invention have many advantages, wherein the advantages aforementioned not required in all versions of the invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector, suitable for a storage device having a storage module, the connector comprising:

a body;

a plurality of terminals, disposed in the body, wherein a first end of each terminal protrudes from the body and is electrically connected to the storage module; and a first housing, covering the body, wherein the first housing has a first indentation and a shielding portion, the first end of each terminal is located at the first indentation, and the shielding portion shields the first indentation, and the first end of each terminal is located between the shielding portion and the storage module.

2. The connector according to claim 1, wherein the first housing further has a pair of wing portions extending from opposite sides of the shielding portion in a direction departing away the first indentation, and the connector is assembled to the storage module by means of the pair of wing portions.

3. The connector according to claim 1, wherein the body has a first protrusion portion located at the first indentation, the first protrusion portion abuts between the shielding portion and the storage module, the first protrusion portion has a second indentation corresponding to the first indentation, and the first end of each terminal is located at the second indentation.

4. The connector according to claim 1, wherein the first housing further has an elastic piece, the storage device further comprises a second housing, the storage module and a portion of the connector are contained in the second housing, and the elastic piece abuts against the second housing.

5. The connector according to claim 1, wherein the body further has a second protrusion portion extending in a direction departing away from the shielding portion and abutting against a side surface of the storage module.

6. The connector according to claim 1, wherein the first housing and the second housing are conductive.

7. The connector according to claim 1, wherein the body comprises:

a first unit, located adjacent to the first indentation, wherein the terminals penetrate the first unit; and a second unit, sheathing a portion of the first unit, wherein a second end of each terminal penetrates through the second unit and is exposed from the second unit.

8. The connector according to claim 7, wherein the first unit has a third protrusion portion extending in a direction departing away from the first end of each terminal and a second locking portion disposed on the third protrusion, the second unit has a hollow portion, a plurality of slots and a first locking portion which is located on opposite sides of the hollow portion, the third protrusion portion is assembled to the hollow portion, and the first and the second locking portions are locked with each other, so as to assemble the first unit and the second unit, and the second end of each terminal penetrates through the hollow portion and is exposed out of the second unit from each of the corresponding slots.

9. A storage device, comprising:

a storage module, having a first connection interface; and a connector; comprising:

a body;

a plurality of terminals, disposed in the body, wherein a first end of each terminal protrudes from the body and is electrically connected to the storage module; and a first housing, covering the body, wherein the first housing has a first indentation and a shielding portion, the first end of each terminal is located at the first indentation, and the shielding portion shields the first indentation, and the first end of each terminal is located between the shielding portion and the storage module.

10. The storage device according to claim 9, wherein the first housing further has a pair of wing portions extending from opposite sides of the shielding portion in a direction departing away from the first indentation, and the connector is assembled to the storage module by means of the pair of wing portions.

11. The storage device according to claim 9, wherein the body has a first protrusion portion located at the first indentation, the first protrusion portion abuts between the shielding portion and the storage module, the first protrusion portion has a second indentation corresponding to the first indentation, and the first end of each terminal is located at the second indentation.

12. The storage device according to claim 9, wherein the first housing further has an elastic piece, the storage device further comprises a second housing, the storage module and a portion of the connector are contained in the second housing, and the elastic piece abuts against the second housing.

13. The storage device according to claim 9, wherein the body further has a second protrusion portion extending in a direction departing away from the shielding portion and abutting against a side surface of the storage module.

14. The storage device according to claim 9, wherein the first housing and the second housing are conductive.

15. The storage device according to claim 9, wherein the body comprises:

a first unit, located adjacent to the first indentation, wherein the terminals penetrate the first unit; and a second unit, sheathing a portion of the first unit, wherein a second end of each terminal penetrates through the second unit and is exposed from the second unit.

16. The storage device according to claim 15, wherein the first unit has a third protrusion portion extending in a direction departing away from the first end of each terminal and a second locking portion disposed on the third protrusion, the second unit has a hollow portion, a plurality of slots and a first locking portion which is located on opposite sides of the hollow portion, the third protrusion portion is assembled to the hollow portion, and the first and the second locking portions are locked with each other, so as to assemble the first unit and the second unit, and the second end of each terminal penetrates through the hollow portion and is exposed out of the second unit from each of the corresponding slots.

17. The storage device according to claim 15, wherein the second end of each terminal, a portion of the second unit, and a portion of the first housing form a second connection interface.

18. The storage device according to claim 17, wherein the second connection interface complies with a micro universal serial bus (Micro-USB) standard.

19. The storage device according to claim 9, wherein the first connection interface complies with a universal serial bus 2.0 (USB 2.0) standard.

20. The storage device according to claim 9, wherein the first connection interface complies with a universal serial bus 3.0 (USB 3.0) standard.

* * * * *